US005203641A

United States Patent [19]

Kranich

[11] Patent Number: 5,203,641

[45] Date of Patent: Apr. 20, 1993

[54] FLUTING TOOL APPARATUS

[76] Inventor: Lyle D. Kranich, 8575 E. Harney Ln., Lodi, Calif. 95204

[21] Appl. No.: 771,112

[22] Filed: Oct. 4, 1991

[51] Int. Cl.[5] ..... E01C 23/16; E01C 19/22

[52] U.S. Cl. ..... 404/93; 404/97

[58] Field of Search ..... 404/93, 97, 96, 95, 404/42, 75, 89; 15/235.4, 235.5

[56] References Cited

U.S. PATENT DOCUMENTS

| | | | |
|---|---|---|---|
| 775,110 | 11/1904 | Jumper | 404/93 X |
| 988,457 | 4/1911 | Glasscock | 404/97 X |
| 1,306,135 | 6/1919 | Bricker | 404/97 X |
| 2,096,699 | 10/1937 | Shaw | 404/93 X |
| 3,936,210 | 2/1976 | Oehlerking | 404/89 |
| 4,032,249 | 6/1977 | DeVitis | 404/89 |
| 4,397,581 | 8/1983 | Jarvis | 404/97 |
| 4,848,961 | 7/1989 | Rouillard | 404/97 X |

*Primary Examiner*—Ramon S. Britts
*Assistant Examiner*—Nancy P. Connolly
*Attorney, Agent, or Firm*—Leon Gilden

[57] ABSTRACT

A tool arranged for imparting a pattern upon a malleable surface to include a plate formed with a forward edge and the forward edge including a plurality of equally spaced recesses directed into the plate through the forward edge. The tool structure is arranged to include a further plate member positioned below and in a spaced relationship relative to the firstly noted plate for mounting a guide block thereon, with the guide block defining a recess to receive the lower plate complementarily therewithin, with the guide block including a plurality of guide rods telescopingly mounted within the guide block arranged in a parallel relationship relative to the upper plate and lower plate in use. The guide block is arranged to position one of the guide rods within a groove of the malleable surface and a second guide rod positioned adjacent a corner to guide the tool structure relative to a side wall and forward wall of an associated surface to be fluted.

6 Claims, 4 Drawing Sheets

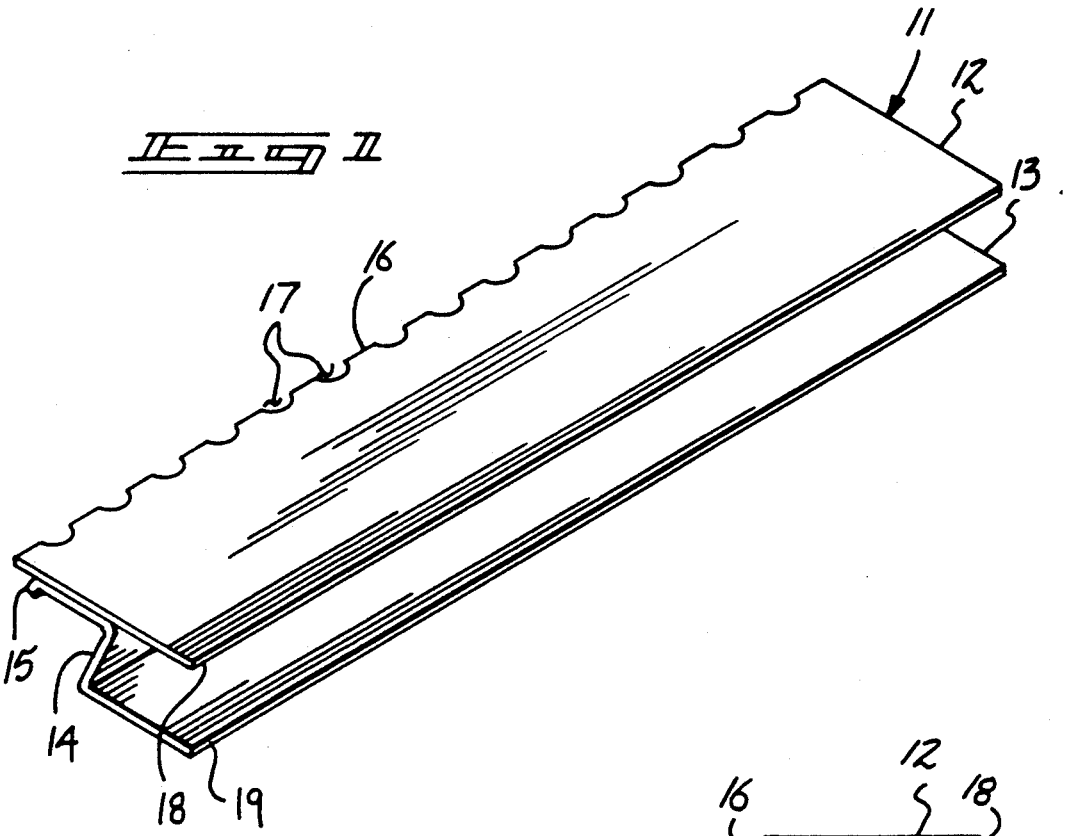
FIG 1
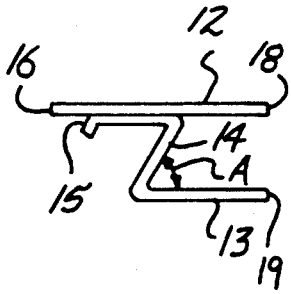
FIG 2
FIG 3
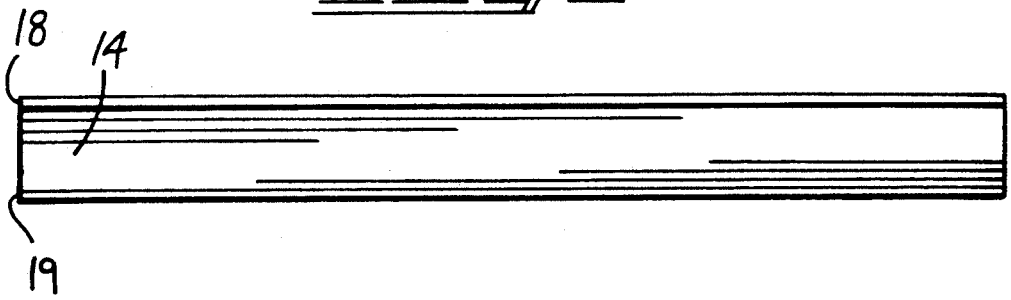

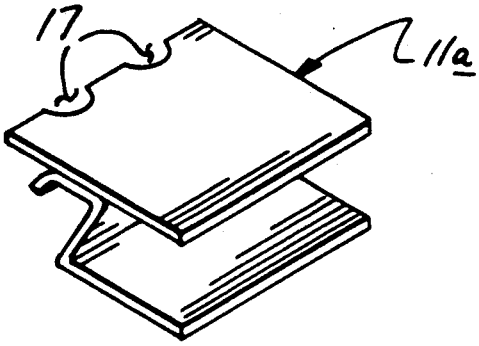
FIG 4
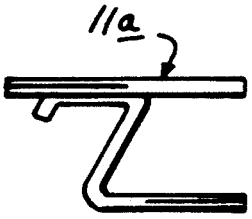
FIG 5
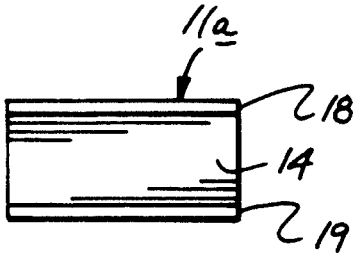
FIG 6
FIG 7
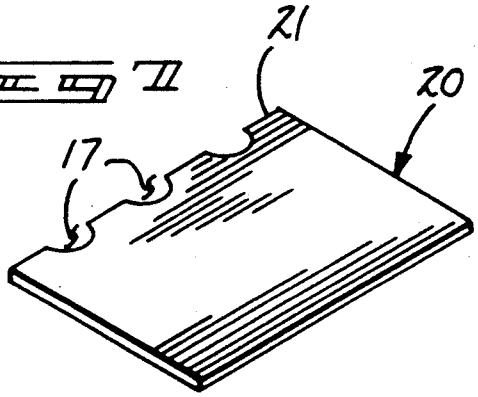
FIG 8
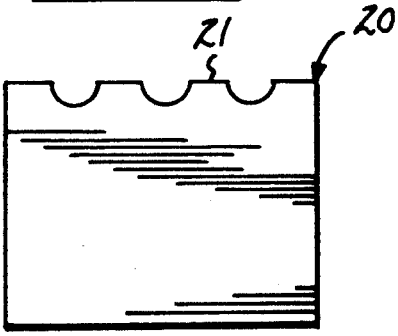
FIG 9
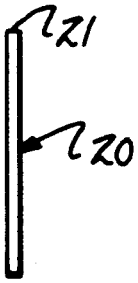

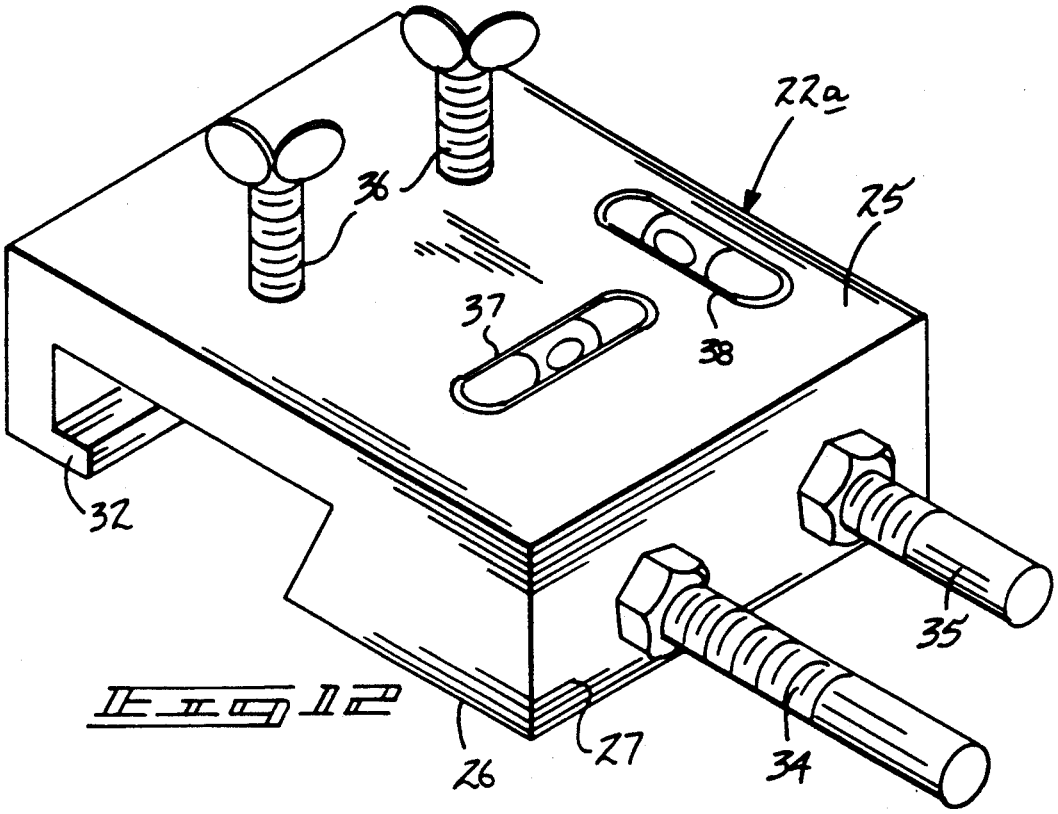
FIG 12
FIG 13
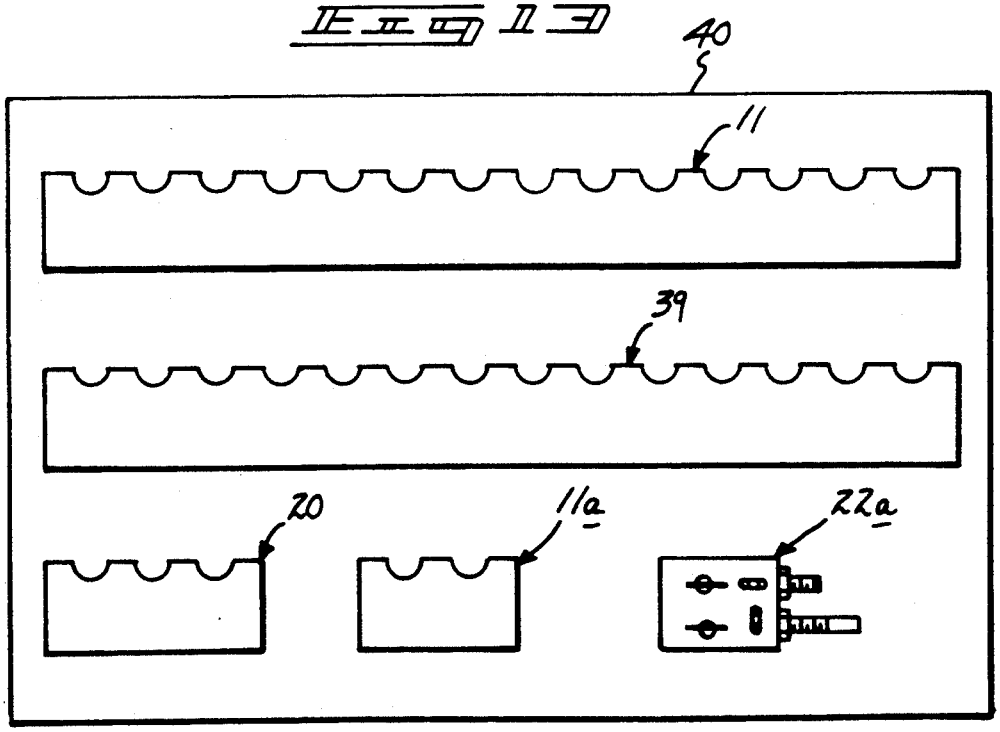

FLUTING TOOL APPARATUS

BACKGROUND OF THE INVENTION

1. Field of the Invention

The field of invention relates to finishing tools, and more particularly pertains to a new and improved fluting tool apparatus wherein the same is arranged for forming a pattern upon a surface of malleable material such as uncured cement and the like.

2. Description of the Prior Art

Various finishing tools have been utilized in the prior art to impart various finishing patterns onto a surface formed of malleable material, such as cement and the like. Such apparatus is exemplified in U.S. Pat. No. 4,050,864 wherein panels are directed between spaced rollers of a machine to impart a scribing pattern utilizing various tools that are mounted relative to the surface of the panel to be decorated.

U.S. Pat. No. 4,776,723 to Brimo sets forth a concrete stamping tool arranged for stamping impressions upon a cementuous surface.

U.S. Pat. No. 3,754,729 to Maynen sets forth a tool to impart a groove onto a concrete wall form utilizing a tool form with a serrated plate mounted to a rearwardly projecting hand grip member.

U.S. Pat. No. 4,105,354 to Bowman sets forth a pattern forming wheel wherein a tubular structure is arranged to receive a plurality of individuals therewithin to impart a pattern upon a cementuous surface by the individuals effecting propulsion of the cylinder over the uncured concrete surface.

U.S. Pat. No. 4,828,426 to Hendricks, et al. sets forth a pattern imparting tool arranged for a cementuous surface arranged to be projected onto a concrete surface mounting a jig structure.

Accordingly, it may be appreciated that there continues to be a need for a new and improved fluting tool apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of pattern imparting tools now present in the prior art, the present invention provides a fluting tool apparatus wherein the same is arranged for its traverse of a malleable surface to impart parallel grooves to the surface. As such, the general purpose of the present invention, which will be described subsequently in greater detail, is to provide a new and improved fluting tool apparatus which has all the advantages of the prior art scribing tool apparatus and none of the disadvantages.

To attain this, the present invention provides a tool arranged for imparting a pattern upon a malleable surface to include a plate formed with a forward edge and the forward edge including a plurality of equally spaced recesses directed into the plate through the forward edge. The tool structure is arranged to include a further plate member positioned below and in a spaced relationship relative to the firstly noted plate for mounting a guide block thereon, with the guide block defining a recess to receive the lower plate complementarily therewithin, with the guide block including a plurality of guide rods telescopingly mounted within the guide block arranged in a parallel relationship relative to the upper plate and lower plate in use. The guide block is arranged to position one of the guide rods within a groove of the malleable surface and a second guide rod positioned adjacent a corner to guide the tool structure relative to a side wall and forward wall of an associated surface to be fluted.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fluting tool apparatus which has all the advantages of the prior art scribing tools and none of the disadvantages.

It is another object of the present invention to provide a new and improved fluting tool apparatus which may be easily and efficiently manufactured and marketed.

It is a further object of the present invention to provide a new and improved fluting tool apparatus which is of a durable and reliable construction.

An even further object of the present invention is to provide a new and improved fluting tool apparatus which is susceptible of a low cost of manufacture with regard to both materials and labor, and which accordingly is then susceptible of low prices of sale to the consuming public, thereby making such fluting tool apparatus economically available to the buying public.

Still yet another object of the present invention is to provide a new and improved fluting tool apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a scribing tool utilized by the invention.

FIG. 2 is an orthographic side view of the tool as set forth in FIG. 1.

FIG. 3 is an orthographic rear view of the tool as set forth in FIG. 1.

FIG. 4 is an isometric illustration of a modified scribing tool of a diminished lineal length.

FIG. 5 is an orthographic side view of the tool as set forth in FIG. 4.

FIG. 6 is an orthographic rear view of the tool as set forth in FIG. 4.

FIG. 7 is an isometric illustration of the unitary fluting plate utilized by the invention.

FIG. 8 is an orthographic top view of the tool as set forth in FIG. 7.

FIG. 9 is an orthographic side view of the tool as set forth in FIG. 7.

FIG. 10 is an isometric illustration of a guide block utilized by the invention.

FIG. 12 is an isometric illustration of a modified guide block as utilized by the invention.

FIG. 13 is an isometric illustration of the organization in a kit form incorporating a plurality of scribing tools in a support housing.

DESCRIPTION OF THE PREFERRED EMBODIMENT

Figure 11:
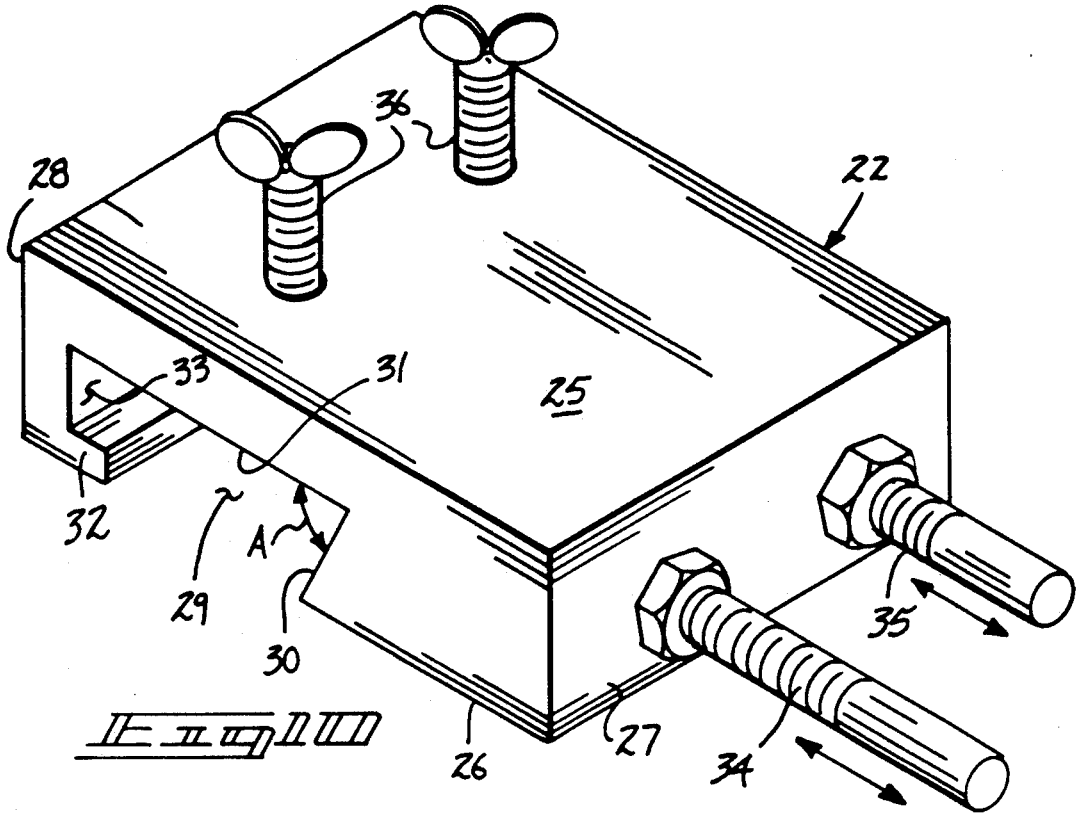
FIG. 11 is an isometric illustration of the invention in as assembled configuration with the guide block and scribing tool, as illustrated.
Figure 11:
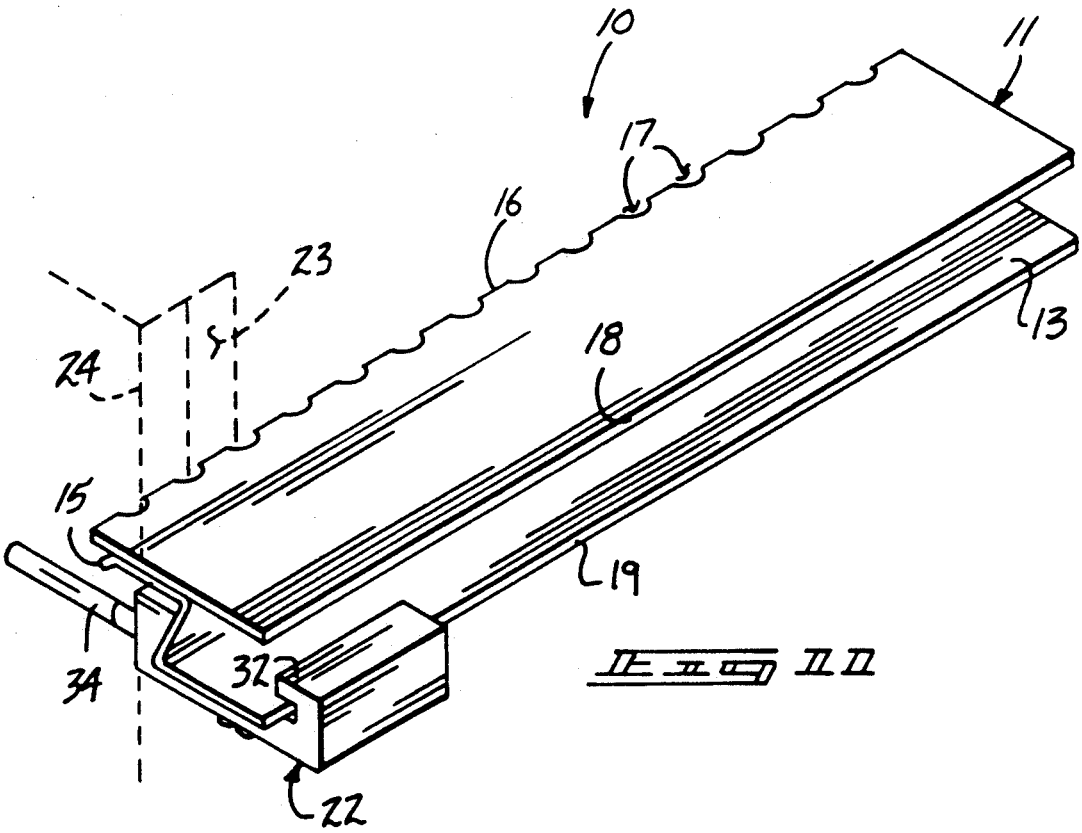

With reference now to the drawings, and in particular to FIGS. 1 to 13 thereof, a new and improved fluting tool apparatus embodying the principles and concepts of the present invention and generally designated by the reference numeral 10 will be described.

More specifically, the fluting tool apparatus 10 of the instant invention essentially comprises the use of a scribing tool 11 formed with a first plate 12 that is parallel to and coextensive to an underlying second plate 13 whose width is less than the width of the first plate 12. The first plate and second plate include respective first and second plate rear edges 18 and 19 that are in a single plane, wherein the single plane is orthogonally oriented relative to the first and second plates to accommodate ease of grasping of the scribing tool 11. The first and second plate include a connecting web 14 that is canted and fixedly mounted between the first and second plates, with the connecting web 14 mounted somewhat medially to a bottom surface of the first plate 12 and mounted to a forward edge of the second plate 13. An included predetermined angle "A" defined between the web 14 and the second plate 13 is accordingly defined by the canted orientation of the connecting web 14. A deflecting flange 15 is formed coextensively to the bottom surface of the first plate 12 and is positioned interiorly of the first plate forward edge 16. The deflecting flange 15 provides for deflection of the malleable material that passes between spaced "U" shaped recesses 17 formed within the first edge 16 coextensive therewith. The "U" shaped recesses 17 form a pattern upon a wall surface 23 when the tool is directed therealong, in a manner as illustrated in FIG. 11 for example.

FIG. 4 illustrates a scribing tool 11*a* of a relative shorter lineal length than the tool 11, as illustrated in FIG. 1, for use in narrower portions of a wall 23. Further, a unitary fluting plate 20, such as illustrated in the FIG. 7, may be also formed when use in a finishing procedure subsequent to use of the tool 11, wherein a tool 7 lacks the rigidity of the tool 11 but is suitable for finishing situations. Further, an elongate fluting plate 39, such as illustrated mounted within the support housing 40, is also available for use for this purpose.

The scribing tool 11 is arranged for receiving a guide block 20, wherein the guide block 20 effects guidance of the scribing tool 11 when directed along the wall 23, particularly at a wall corner 24. The guide block includes a block top wall 25 spaced from and parallel a block bottom wall 26. A block front wall 27 orthogonally oriented relative to the top and bottom walls is arranged parallel relative to a block rear wall 28. A bottom wall cavity is directed into the guide block 22 through the bottom wall 26 and extends in a through-extending relationship between the side walls of the guide block 22. The cavity 29 includes a cavity front wall 30 that is defined by the predetermined acute angle "A" relative to a cavity floor 31 that is arranged parallel to the top wall 25. The predetermined acute angle "A" accommodates the connecting web 14 in a complementary manner when the guide block is mounted to the scribing tool 11, as illustrated in FIG. 11. An "L" shaped flange 32 is formed by the rear wall 28 to define a receiving slot 33 to receive the second plate rear edge 19 to thereby secure the second plate 13 and the connecting web 14 within the cavity 29. A plurality of locking rods 36 orthogonally directed through the top wall 25 extending into the cavity 29 effect an abutment within an engagement with a bottom surface of the second plate 13 to thereby project the second plate 13 against the "L" shaped flange 32 that includes a leg parallel and spaced from the floor 31, as well as directing in a frictionally engaging manner the connecting web 14 against the cavity front wall 30. A respective first and second adjusting rod 34 and 35 are telescopingly mounted through the front wall 27 and are orthogonally oriented relative to the front wall. The adjusting rods 34 and 35 are adjusted, wherein one of the adjusting rods is positioned to engage the wall 23 while the remaining adjusting rod is arranged to project beyond the wall 23 about the corner 24 to provide a guide surface to guidance of the scribing tool along the wall 23. To assist in the alignment of the scribing tool in use, the guide block may optionally be provided with a respective first and second spirit level 37 and 38 that are orthogonally oriented and mounted within the top wall 25 to provide for a desired alignment of the block and associated scribing tool 11 in engagement with the wall 23.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1.A fluting tool apparatus comprising, a scribing tool, said scribing tool including a first plate, said first plate including a first plate forward edge spaced from and parallel to a first plate rear edge, said first plate forward edge including a series of spaced recesses directed into the first plate from the first plate forward edge, wherein said scribing tool further includes a second plate spaced below the first plate in a parallel coextensive relationship, wherein the first plate is defined by a first width and the second plate is defined by a second width that is less than the first width, said second plate includes a second plate rear edge, wherein the first plate rear edge and the second plate rear edge are arranged in a single plane relative to each other wherein said single plane is orthogonally orientated relative to the first plate and the second plate, a connecting web is fixedly mounted between the first and the second plate wherein the connecting web is mounted to a forward edge of the second plate and defines a predetermined acute angle between the connecting web and the second plate, and wherein the connecting web is mounted to a bottom surface of the first plate substantially medially of said bottom surface of the first plate.

2. An apparatus as set forth in claim 1 including a deflecting flange mounted to the bottom surface of the first plate forwardly of the connecting web and positioned rearwardly of the first plate forward edge, wherein the recesses project into the first plate spaced from the deflecting flange, wherein the deflecting flange is oriented for deflecting malleable material the first plate forward edge is imparted against.

3. An apparatus as set forth in claim 2 including a guide block, the guide block arranged for securement to the second plate and the connecting web, wherein the guide block includes a guide block top wall spaced from and parallel with a guide block bottom wall, and a guide block front wall orthogonally oriented relative to the guide block top wall and the guide wall bottom wall, wherein the guide wall front wall is arranged parallel to a guide block rear wall, and the guide block including a bottom wall cavity directed into the guide block from the guide block bottom wall thereby arranged to receive the first plate and connecting web therewithin.

4. An apparatus as set forth in claim 3 wherein the bottom wall cavity includes a cavity front wall and a cavity floor, the cavity floor arranged in a spaced parallel relationship relative to the guide block top wall, and wherein the cavity front wall and the cavity floor define an included angle equal to the predetermined acute included angle which complimentarily accommodates the connecting web in contiguous communication with the cavity front wall.

5. An apparatus as set forth in claim 4 wherein the guide block rear wall defines an "L" shaped flange, the "L" shaped flange defines a receiving slot receiving the second plate rear edge therewithin, and at least one locking rod orthogonally directed through the guide block top wall and projecting into the bottom wall cavity beyond the cavity floor, wherein the at least one locking rod is telescopingly mounted in an adjustable manner through the guide block in abutting relationship with a bottom surface of the second plate.

6. An apparatus as set forth in claim 5 wherein the guide block includes a plurality of adjusting rods including a first adjusting rod and a second adjusting rod, wherein the first adjusting rod and the second adjusting rod are arranged in a parallel relationship relative to one another and orthogonally oriented relative to the guide block front wall, wherein the first adjusting rod and the second adjusting rod are telescopingly and adjustably mounted within the guide block thereby permitting relative extension of each adjusting rod of the first and second adjusting rods relative to the guide block.

* * * * *